US006381798B1

(12) United States Patent
Rutkowski et al.

(10) Patent No.: US 6,381,798 B1
(45) Date of Patent: May 7, 2002

(54) SPRING CLUTCH FOR DRAIN CLEANING MACHINES

(75) Inventors: Michael J. Rutkowski, Brunswick; Larry F. Babb, Grafton, both of OH (US)

(73) Assignee: Emerson Electric Co., St. Louis, MO (US)

( * ) Notice: Subject to any disclaimer, the term of this patent is extended or adjusted under 35 U.S.C. 154(b) by 0 days.

(21) Appl. No.: 09/471,366

(22) Filed: Dec. 23, 1999

(51) Int. Cl.[7] ..... B08B 9/02
(52) U.S. Cl. ..... 15/104.33
(58) Field of Search ..... 15/104.31, 104.32, 15/104.33

(56) References Cited

U.S. PATENT DOCUMENTS

| | | | | |
|---|---|---|---|---|
| 2,223,005 A | * | 11/1940 | Kerber | 15/104.33 |
| 2,619,665 A | * | 12/1952 | Hopkins et al. | 15/104.33 |
| 2,730,740 A | | 1/1956 | O'Brien | 15/104.33 |
| 3,007,186 A | | 11/1961 | Olsson | 15/104.33 |
| 3,095,592 A | * | 7/1963 | Hunt | 15/104.33 |
| 3,246,354 A | | 4/1966 | Cooney et al. | 15/104.33 |
| 3,747,153 A | | 7/1973 | O'Neill | 15/104.33 |
| 4,716,613 A | | 1/1988 | Irwin | 15/104.33 |
| 4,914,775 A | | 4/1990 | Kirk | 15/104.33 |
| 5,031,276 A | | 7/1991 | Babb et al. | 15/104.33 |
| 5,309,595 A | | 5/1994 | Salecker et al. | 15/104.33 |
| 5,390,389 A | | 2/1995 | Rutkowski et al. | 15/104.33 |

* cited by examiner

*Primary Examiner*—Mark Spisich
(74) *Attorney, Agent, or Firm*—Vickers, Daniels & Young

(57) ABSTRACT

A belt driven drum-type drain cleaning machine in which the drive motor is spring biased to tension the drive belt is provided with a spring arrangement by which slippage between the drive belt and drive pulley is intentionally achieved in response to the imposition of a predetermined torque on the drain cleaning cable during use of the machine.

34 Claims, 8 Drawing Sheets

SPRING CLUTCH FOR DRAIN CLEANING MACHINES

BACKGROUND OF THE INVENTION

This invention relates to the art of drain or sewer cleaning machines and, more particularly, to a spring clutch arrangement for such machines of the character having a flexible plumber's cable or snake coiled within a belt driven drum from which the snake is withdrawn and inserted into a drain or sewer to be cleaned.

Belt driven drum-type sewer cleaning machines of the character to which the present invention is directed are well-known and are shown; for example, in U.S. Pat. No. 2,730,740 to O'Brien, U.S. Pat. No. 3,007,186 to Olsson, U.S. Pat. No. 3,246,354 to Cooney, et al., U.S. Pat. No. 3,747,153 to O'Neill, U.S. Pat. No. 4,716,613 to Irwin, U.S. Pat. No. 5,031,276 to Babb, et al., U.S. Pat. No. 5,309,595 to Salecker, et al., and U.S. Pat. No. 5,390,389 to Rutkowski, et al. The disclosures of the foregoing patents are hereby incorporated herein by reference for background information. In the foregoing patents, the drum is rotated by an endless belt trained about a motor driven pulley and the outer periphery of the drum or a drum mounted pulley, and in the O'Brien, Olsson, Cooney, et al., and O'Neill, patents the motor support table or platform is secured to a post or posts by thumb screw components or the like to tension the belt for driving the drum in response to operation of the electric motor. In the patents to Irwin, Babb, et al., Salecker, et al., and Rutkowski, et al., a biasing spring arrangement is provided between the machine frame and motor platform for maintaining the driving tension on the endless belt. In belt driven drums of the foregoing character heretofore provided, a tension is maintained on the belt so as to intentionally preclude any slippage between the belt and motor driven pulley. These machines are used by professionals who do not want such slippage. Rather, an operator's skill and experience is relied upon for controlling operation of the drive motor so as to preclude overheating thereof and/or problems attendant to the application of an excessively high torque on the drain cleaning snake during use of the machine. Moreover, there was no slippage between the belt and drive pulley even in those machines which included a spring or springs to tension the drive belt in that the latter springs were intentionally strong enough to preclude slippage. The purpose of the spring arrangement in the prior art was to facilitate a release of the drive belt by pushing against the biasing spring force to displace the drive pulley toward the drum axis to facilitate disengagement of the belt from the drive pulley. Efforts to avoid or minimize damage to the snake and/or drive motor in the machines heretofore available included the use of clutch mechanisms incorporated in the drive pulley, such as that shown in U.S. Pat. No. 5,033,990 to Silverman.

Today, such drain cleaning machines are available to inexperienced operators through the rental market or retail markets, the use of such machines by inexperienced operators can result in the overloading and damaging of the snakes or cables as well as the overloading and damaging of the drive motors. More particularly in this respect, an inexperienced operator is not likely to have a "feel" for the engagement of the leading end of the snake with an obstruction which either cannot be easily penetrated or which interengages with the snake so as to preclude rotation of the leading end thereof, the latter of which can result in damage to the snake and both of which impose an undesirably high load on the drive motor. Some drive motors for such drain cleaning apparatus have a thermal cut-out which will stop the motor if the latter becomes too hot as a result of overloading and, if there is no thermal cut-out, the drive motor can be damaged by overheating. Moreover, even if there is a thermal cut-out, the effect of overheating is cumulative, whereby the life of the drive motor is reduced. While it might be possible to impose a torque on the snake which could result in slippage between the belt and drive motor prior to the latter stopping through the operation of a thermal cut-out or because of a burn-out condition of the motor, such slippage is not intentional, results in extremely high frictional interengagement between the belt and drive motor pulley causing deterioration of the belt. Moreover, since such slippage is not intentional, the drive motor is still subject to the damaging affect of overheating. The end result is high maintenance and/or replacement costs due to damage to one or more of the drain cleaning snake, drive belt and drive motor.

SUMMARY OF THE INVENTION

In accordance with the present invention, a slip clutch arrangement is provided for a belt driven drum-type drain cleaner in which one or more springs of predetermined force bias the drive motor to provide a predetermined tension in the drive belt which provides for slippage between the drive belt and drive pulley in response to the imposition of a predetermined torque on the snake during operation of the apparatus. Accordingly, should the leading end of the snake encounter an obstruction during use of the apparatus which imposes an undesirably high torque on the snake, the drive belt will slip relative to the drive motor pulley so as to preclude rotation of the drum and snake. This advantageously prevents damage to the snake and precludes the imposition of a load on the drive motor causing the latter to overheat. Advantageously, a slip clutch arrangement in accordance with the present invention provides drain cleaning apparatus which can be used by an inexperienced operator, such as a home owner, without potentially damaging the snake and/or drive motor by torsionally overloading the snake and/or thermally overloading the drive motor. In accordance with one aspect of the invention, the drive motor is mounted on a pivotal lever between the pivot axis for the lever and a spring of predetermined force acting against the lever to bias the motor to tension the drive belt. In accordance with another aspect of the invention, the motor is mounted on a reciprocable table which is biased by one or a pair of springs having a predetermined spring force to bias the motor to tension the drive belt. In accordance with yet another aspect of the invention, the spring force is adjustable so that the drive pulley will slip relative to the belt in response to the imposition of different torsional forces on the snake. Accordingly, snakes of different diameter can be used with a given drain cleaning machine by adjusting the spring force to provide for slippage between the drive belt and drive pulley at a torque which is appropriate for the particular diameter of snake being used.

It is accordingly an outstanding object of the present invention to provide improved belt driven drum-type drain cleaning apparatus which avoids damage to the plumbing snake and/or drive motor of the apparatus as the result of the imposition of an undesirably high torque on the snake during use of the apparatus.

Another object is the provision of improved apparatus of the foregoing character wherein slippage between the drive belt and drive motor pulley is intentionally achieved in response to the imposition of a predetermined torque on the drain cleaning snake.

A further object is the provision of improved apparatus of the foregoing character wherein the drum drive motor is spring biased to tension the drive belt using a predetermined spring force which results in slippage between the belt and drive pulley in response to the imposition of a predetermined torque on the drain cleaning snake.

Still another object is the provision of improved apparatus of the foregoing character wherein the spring force is adjustable enabling varying the tension on the drive belt and thus the predetermined torque on the drain cleaning snake at which slippage occurs between the drive belt and drive motor pulley.

Still a further object is the provision of improved apparatus of the foregoing character which enables operation of the apparatus by inexperienced persons while minimizing or eliminating the likelihood of damage to the drain cleaning snake and/or drive motor resulting from torsional and/or thermal overloading there of during operation of the apparatus.

BRIEF DESCRIPTION OF THE DRAWINGS

The foregoing objects, and others, will in part be obvious and in part pointed out more fully hereinafter in conjunction with the written description of preferred embodiments of the invention illustrated in the accompanying drawings in which.

DESCRIPTION OF PREFERRED EMBODIMENTS

Figure 1:
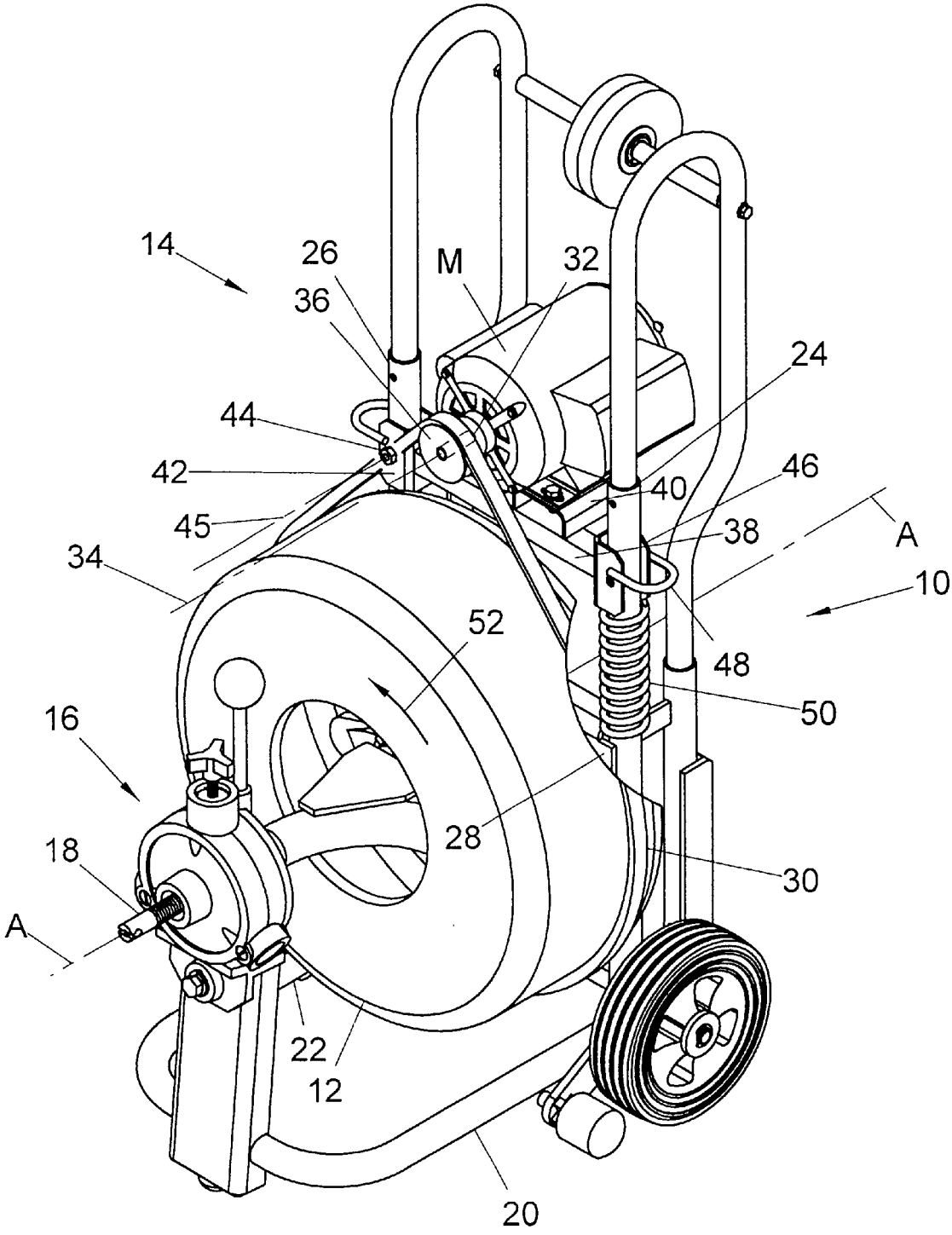
FIG. 1 is a perspective view of a belt driven drum-type drain cleaning apparatus having a slip clutch arrangement in accordance with the present invention.

Referring now in greater detail to the drawings, wherein the showings are for the purpose of illustrating preferred embodiments of the invention only, and not for the purpose of limiting the invention, FIG. 1 illustrates a portable, belt driven drum-type drain cleaning machine having a slip clutch arrangement in accordance with the present invention and which, with the exception of a modification described hereinafter, corresponds to a drain cleaning machine available from Ridge Tool Company of Elyria, Ohio under the latter's product designation Model K-750. The structure and operation of the latter machine is disclosed and described in the aforementioned U.S. Pat. No. 5,031,276 to Babb, et al., whereby reference can be made to the patent for the details of construction and operation of the machine. Basically, as shown in FIG. 1, this drain cleaning machine comprises a wheeled frame assembly 10 supporting a rotatable snake drum unit 12, a drum driving arrangement 14 and a snake feeding mechanism 16. Drum unit 12 contains a flexible plumber's snake 18 which extends outwardly through feed mechanism 16 and which is adapted to be rotated with drum unit 12 and displaced inwardly and outwardly relative to the drum unit during operation of the machine through the manipulation of feed mechanism 16. Frame assembly 10 includes bottom members 20 and 22 and leg members 24 and 26 extending upwardly therefrom, respectively, at the rear end of the machine. Legs 24 and 26 are interconnected intermediate their lower and upper ends by a crossbar 28, not shown, and drum unit 12 is mounted on the crossbar for rotation about a drum axis A. Drum driving arrangement 14 comprises an electric drive motor M which is adapted to drive an endless belt 30 which engages about the outer periphery of the housing of drum unit 12. More particularly in this respect, motor M has a drive shaft 32 rotatable about a motor axis 34 which is parallel to drum axis A, and drive belt 30 is trained about a drive pulley 36 which is mounted on shaft 32 for rotation therewith, whereby the belt is driven in response to rotation of shaft 32 to rotate drum unit 12.

Motor M is pivotally supported on frame assembly 10 by means of an arm assembly including a laterally extending support member 38, and a support member 40 thereon and extending rearwardly therefrom and on which motor M is mounted such as by nut and bolt assemblies, not shown. One end of support member 38 is provided with a laterally outwardly open U-shaped bracket 42 which is welded to member 38 and which receives leg 26 of the frame assembly between the flanges thereof. The arm assembly is pivotally mounted on leg 26 by means of a nut and bolt assembly 44 for displacement about a pivot axis 45 parallel to and offset from drive motor axis 34. The opposite end of support member 38 is provided with a laterally outwardly open U-shaped bracket 46 which is welded to the corresponding end of member 38 and which receives leg 24 between the flanges thereof. Bracket 46 is provided with a laterally outwardly extending handle 48 by which the arm assembly and thus motor M is adapted to be pivoted about the axis provided by nut and bolt assembly 44. A coiled compression spring 50 surrounds leg 24 of the frame assembly between the lower end of bracket 46 and the upper side of cross member 28 of the frame assembly to bias the motor supporting arm assembly upwardly in FIG. 1 and thus counterclockwise about pivot axis 45 to tension drive belt 30. The drum and motor axes are in a common vertical plane and support member 38 is between the two axes and extends laterally of the plane. In the machine illustrated in FIG. 1, drum assembly 12 is rotatable in just one direction which, as indicated by arrow 52, is counterclockwise about drum axis A. The displacement of snake 18 outwardly and inwardly of the drum is controlled by the disposition of feed mechanism 16. Accordingly, it will be appreciated that during the feeding of snake 18 outwardly of the drum unit and into a drain to be cleaned the torque applied to the snake results in the driving connection between the drive pulley, belt and drum tending to pivot the motor supporting arm assembly clockwise about pivot axis 45 so as to compress spring 50 and reduce the tension on belt 30. Therefore, by providing for spring 50 to have a predetermined force, slippage between drive pulley 36 and belt 30 can be made to occur at a predetermined or desired torque on snake 18.

Figure 5:
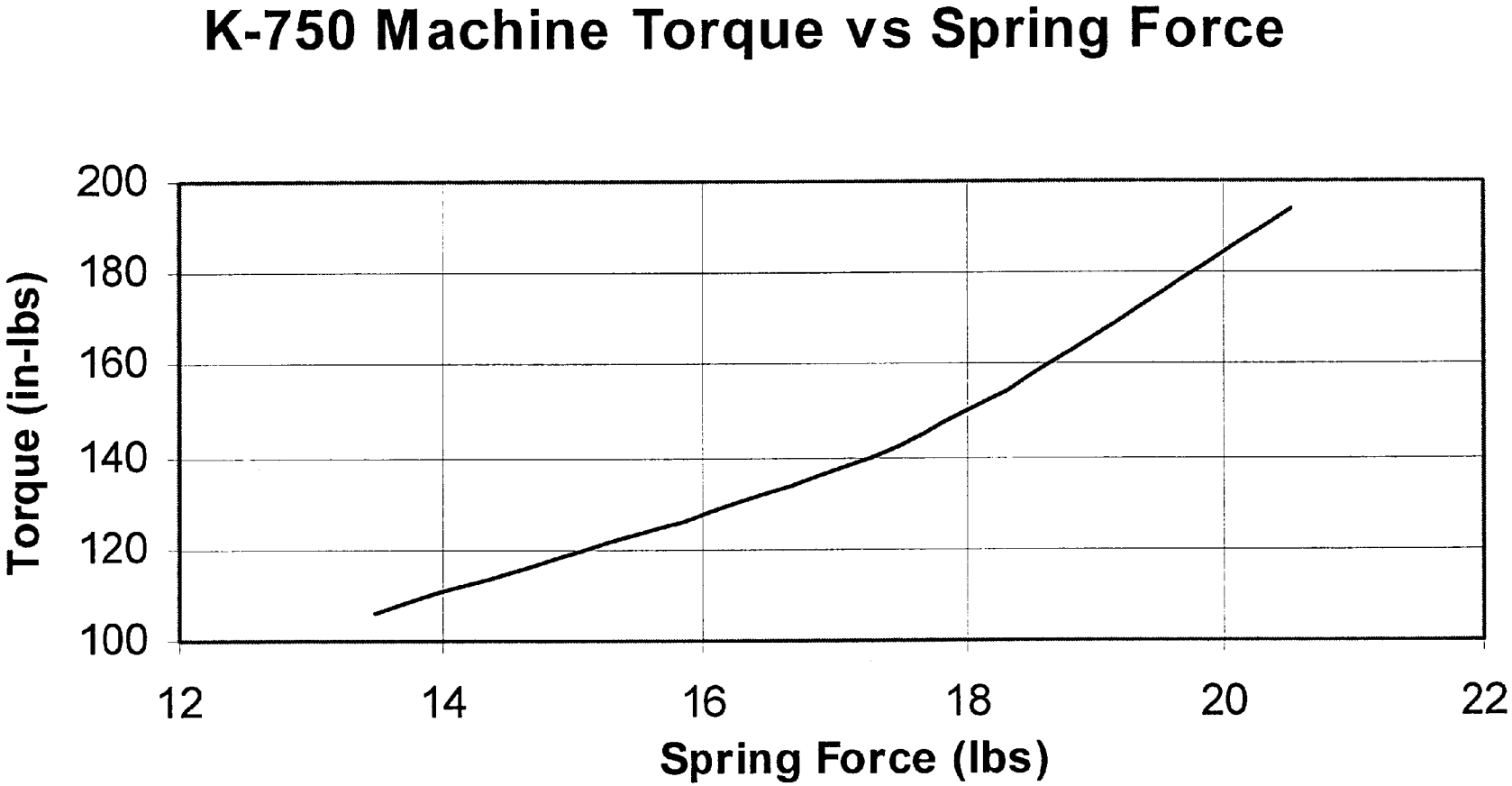
FIG. 5 is a torque vs spring force graph for a drain cleaning machine such as that shown in FIGS. 1 and 2 of the drawing.

In connection with obtaining slippage between the belt and drive pulley in accordance with the present invention, there are a number of variables from one drain cleaning machine to another which affect the spring force necessary to achieve slippage at a predetermined torque during operation of a given drain cleaning machine. These variables include the diameter of the drive pulley, the diameter of the snake drum, the angle of contact between the belt and drive pulley, the coefficient of friction for the drive belt, the weight of the drive motor, and the diameter of the drain cleaning cable or snake. In connection with a drain cleaning machine in which the motor is mounted on a pivotal support member as shown in FIG. 1, further variables include the length of the lever arm between the pivot axis and the axis of the biasing spring and the location of the drive motor between the two axes. As mentioned above, the machine illustrated in FIG. 1 is a modification of the Model K-750 drain cleaning machine of the Ridge Tool Company. In this machine, the drum diameter is 20 inches, the pulley diameter is 2.5 inches, the pulley contact angle is 105 degrees, the coefficient of friction is 1.6, the motor weighs 21 pounds and is centered on the motor support member 38 between pivot axis 45 and the axis of biasing spring 50. In connection with obtaining slippage between the drive pulley and belt in accordance with the present invention, using a ⅝ inch snake, such slippage preferably occurs in response to the application of a torque of from 150 to 160 in. lbs. which, as will be seen from the graph of FIG. 5, requires a spring force of between about 18 and 19 lbs. In contrast, the unmodified K-750 machine, using a ⅝ inch snake, is designed to intentionally preclude slippage in response to the application of a torque of over 200 in. lbs. and, at the latter torque level, the snake and/or drive motor are subjected to potential damage. With further regard to the unmodified K-750 machine, the exception referred to hereinabove between the latter and the machine shown in FIG. 1 resides in reversing the relationship between the direction of rotation of the snake drum and the locations of the pivot axis and spring on the motor support member. In FIG. 1, for example, the unmodified K-750 machine would either be rotated clockwise rather than counterclockwise, or end 42 of support member 38 would be pivotally attached to frame member 24 and spring 50 would be mounted on frame member 26. In either event, rotation of the snake drum in the unmodified machine biases the support arm in the direction to reduce the force of the spring thereon, thus increasing belt tension as the torque applied to the snake increases, and this driving relationship together with a spring force of 60 lbs. precludes slippage between the belt and drive pulley in response to a torque of over 200 in. lbs. on the snake.

Figure 2:
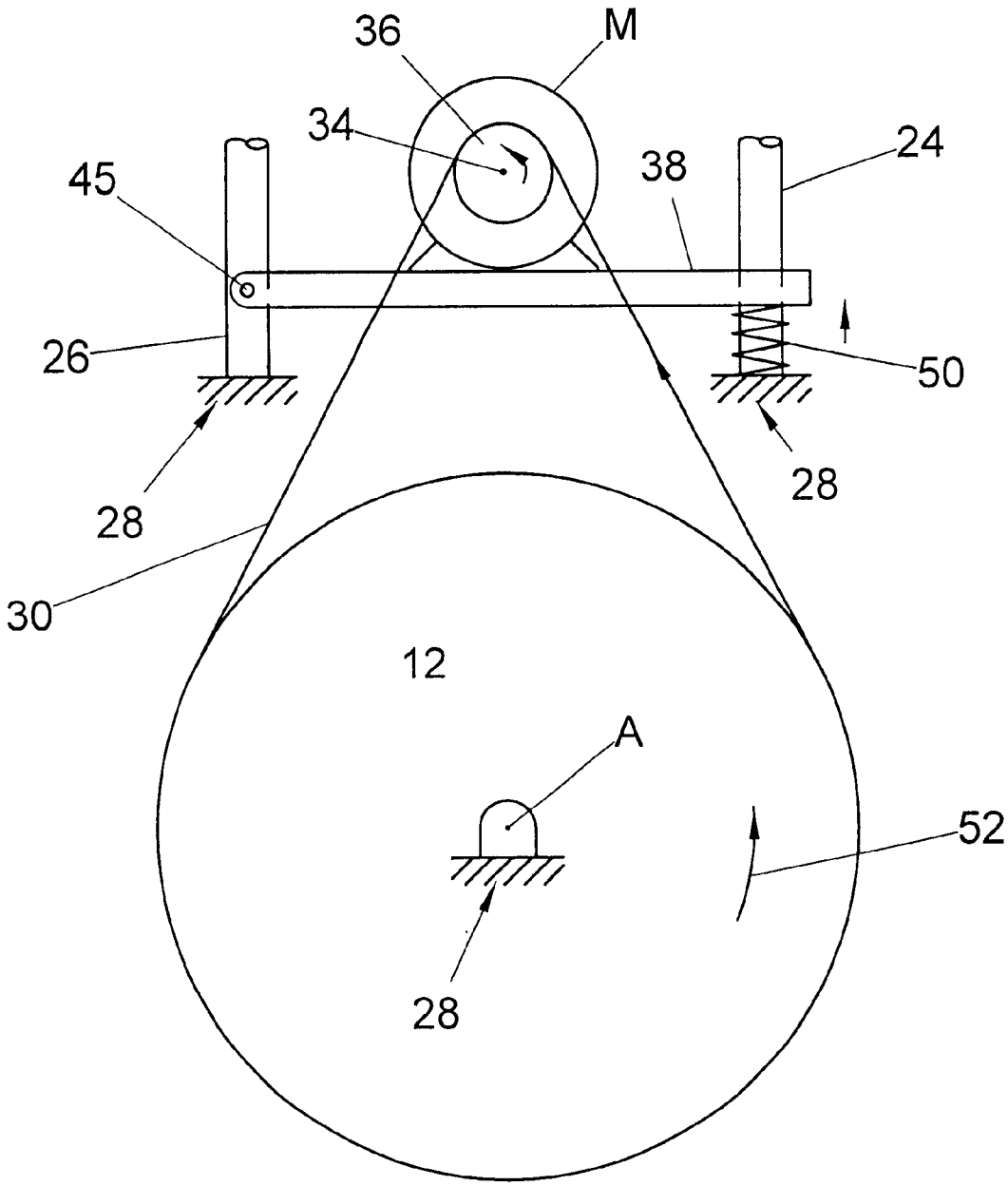
FIG. 2 schematically illustrates the slip clutch arrangement for a drain cleaning machine such as that shown in FIG. 1.
Figure 6:
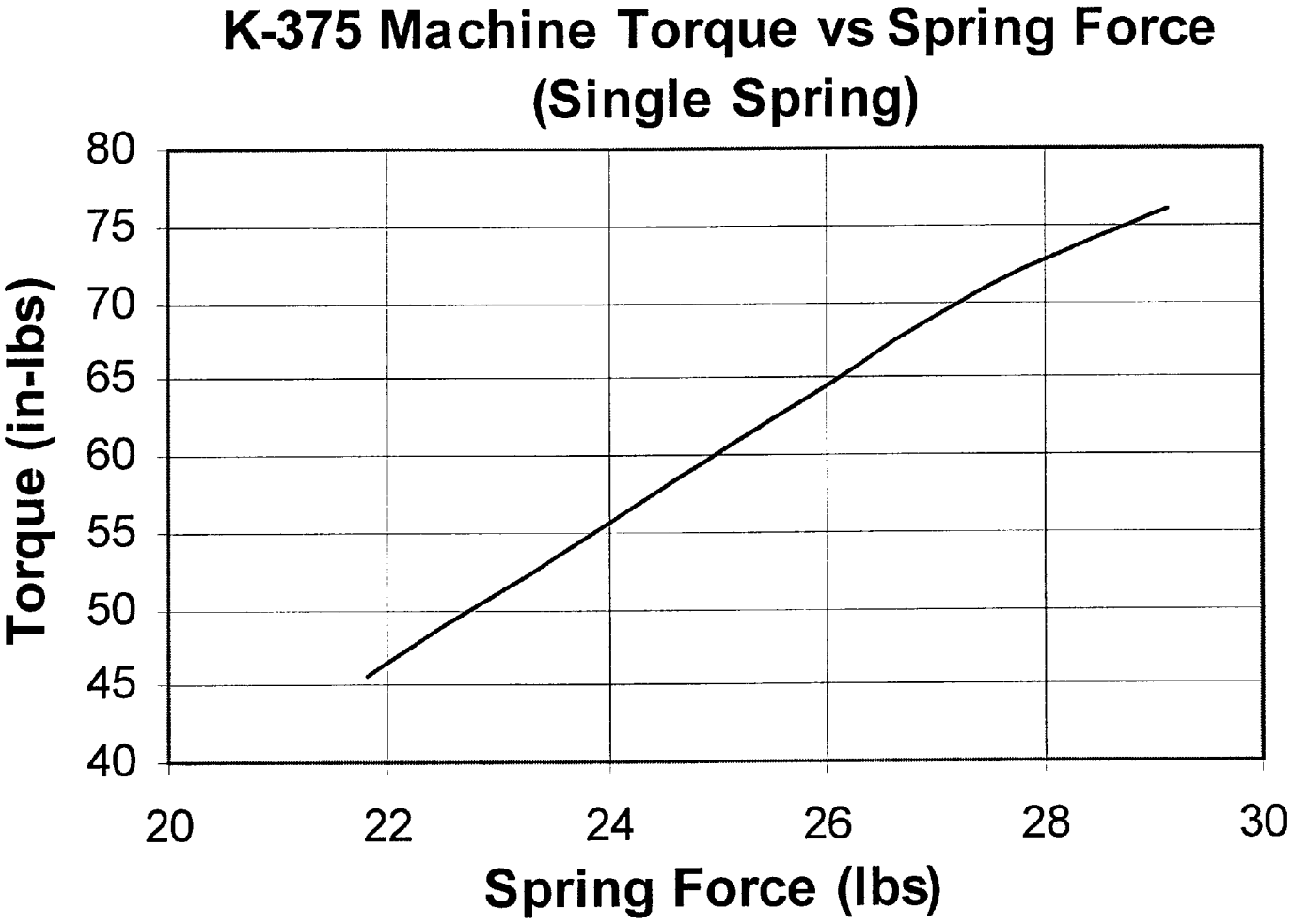
FIG. 6 is a torque vs spring force graph for another drain cleaning machine having a lever mounted motor as shown in FIG. 2.

FIG. 2 also schematically illustrates the motor support and biasing spring arrangement for one version of a modification of the model K-375 machine of the Ridge Tool Company referred to hereinabove. The modification is the same as that described above with respect to the modified K-750 machine, namely reversal of the drive and motor support arrangement. With further regard to the unmodified K-375 machine and the modified version illustrated in FIG. 2, the snake drum has a diameter of 13 inches, the drive pulley has a diameter of 1.5 inches, the pulley contact angle is 89 degrees, the coefficient of friction is 1.6, the motor weighs 15 lbs., the motor support arm is 8.5 inches between the pivot access and spring access, and the motor axis is spaced 5.75 inches from pivot axis 34, whereby the motor is offset with respect to the center of the motor support member. In accordance with obtaining slippage between the drive pulley and belt in accordance with the present invention, such slippage using a ⅜ inch snake is preferably in response to a torque of from 50 to 60 in. lbs. on the snake and, as will be appreciated from the graph of FIG. 6, such slippage is obtained with a spring force of between about 23 and 25 lbs. In connection with the unmodified K-375 machine in which slippage is intentionally precluded, a spring force of between 50 and 60 lbs. is employed to preclude slippage at over 150 in. lbs. of torque on the snake.

Figure 3:
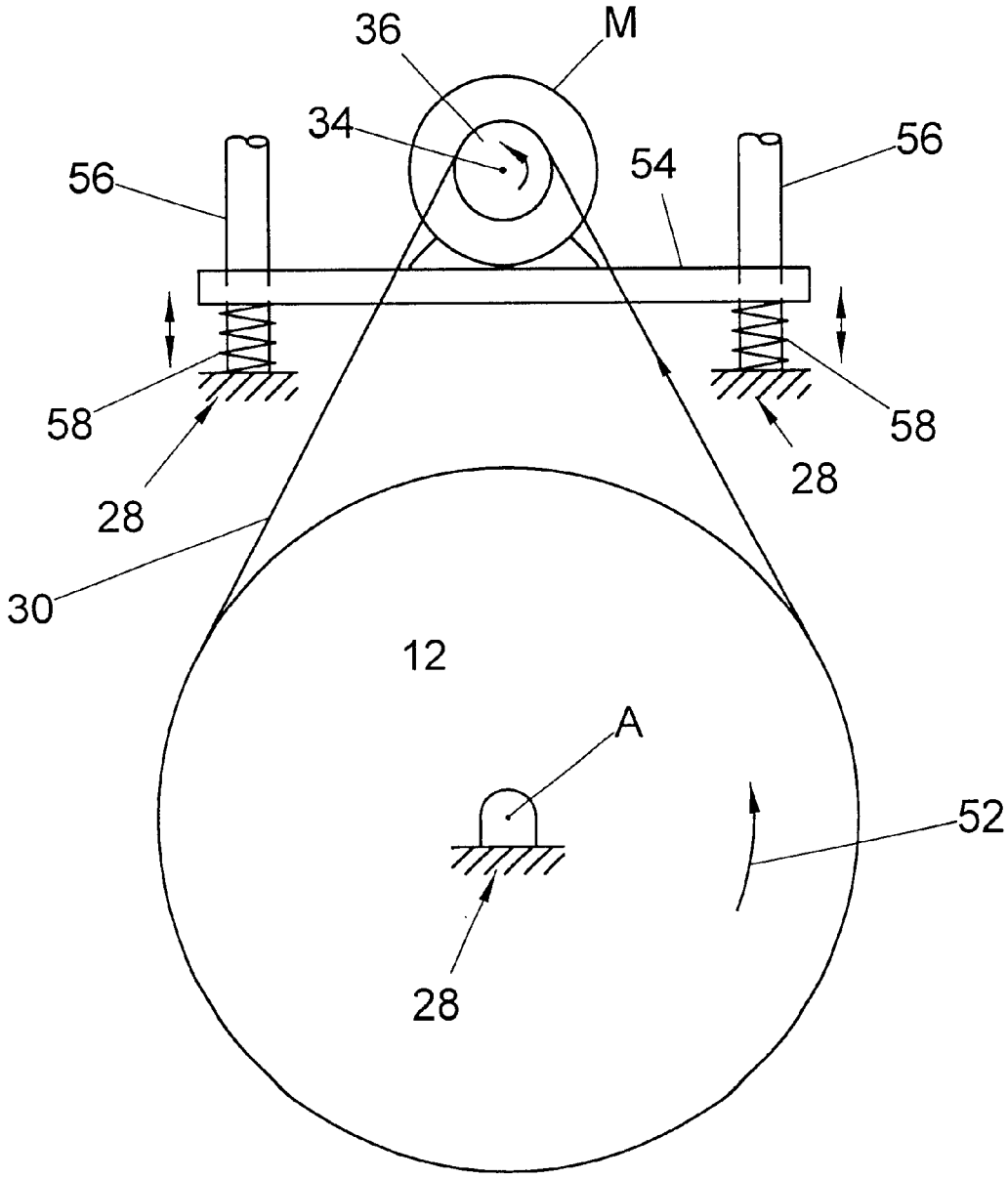
FIG. 3 schematically illustrates a slip clutch arrangement for a drain cleaning machine in which the motor is mounted on a table biased by dual springs.
Figure 7:
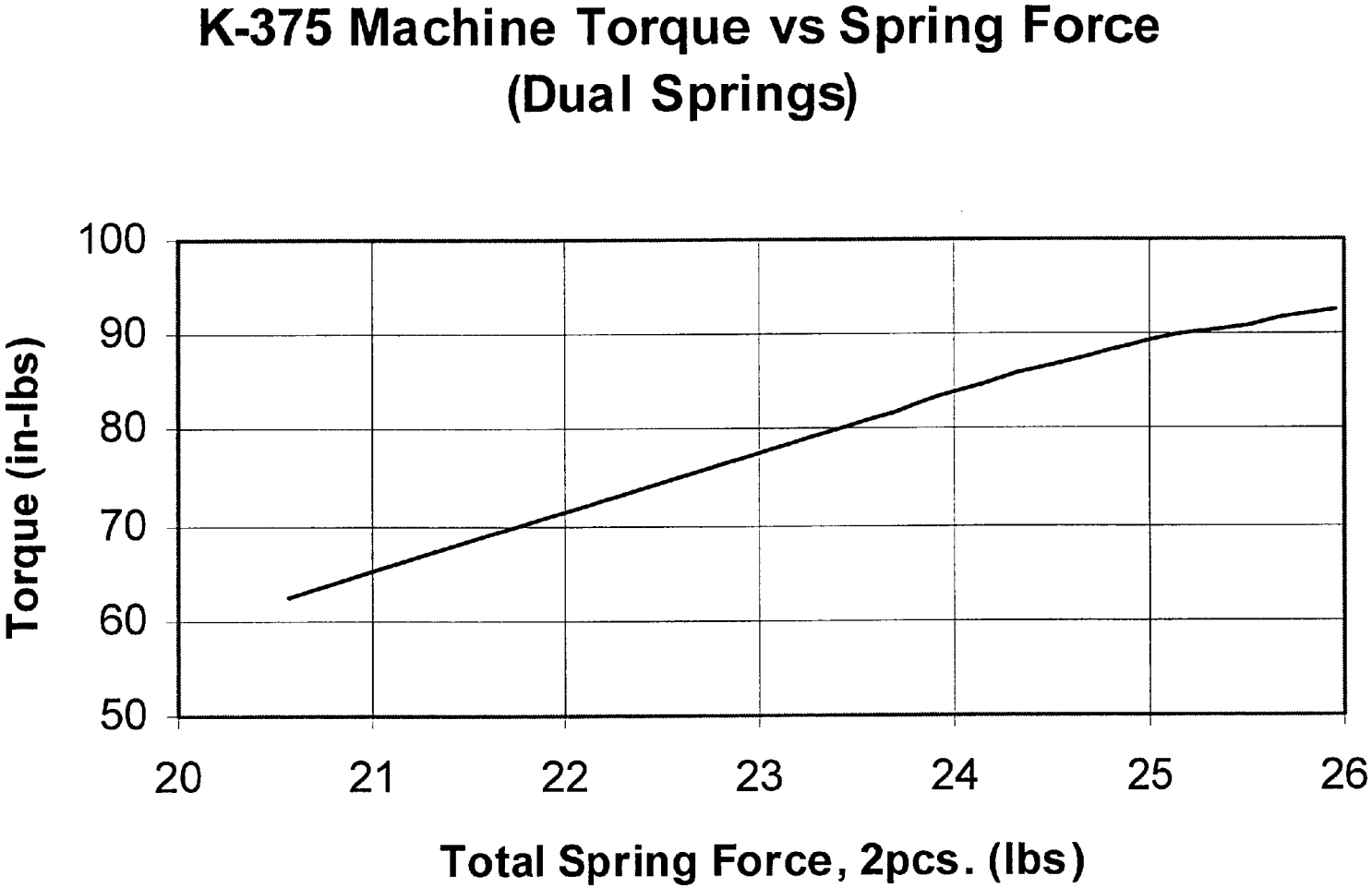
FIG. 7 is a torque vs spring force graph for a drain cleaning machine having a table mounted motor biased by dual springs as shown in FIG. 3; and, FIG. 8 schematically illustrates a slip clutch arrangement for a drain cleaning machine in which the drive motor is table mounted and biased by a single spring to tension the drive belt.

FIG. 3 schematically illustrates another version of the K-375 drain cleaning machine in which the drive motor M is mounted on a support table 54 which is vertically reciprocable relative to a pair of guide posts 56 on frame 10 of the apparatus. Table 54 and thus motor M are biased upwardly relative to axis A of drum 12 by a pair of compression springs 58 surrounding a corresponding one of the posts 56 between frame 10 and table 54. Motor M is centrally located between posts 56, and springs 58 bias table 54 upwardly to tension drive belt 30 and to apply a spring force which is balanced with respect to the opposite ends of the table. The motor and drum axes lie in a common vertical plane, and table 54 is between axes A and 34 and extends transverse to the vertical plane. The specifications of the K-375 machine illustrated in FIG. 3 correspond to those set forth hereinabove with regard to the version illustrated in FIG. 2, and in the version of the K-375 machine illustrated in FIG. 3 in which slippage between the drive belt and drive pulley is intentionally precluded, each of the springs 58 has a force of 21 lbs., whereby slippage is precluded at over 150 in. lbs. of torque on the snake. In connection with obtaining slippage in accordance with the present invention, such slippage is preferably responsive to a torque of from 80 to 90 in. lbs. on the snake and, as will be seen in the graph of FIG. 7, such slippage is achieved with two springs totaling between 23 and 26 lbs. of force, whereby each spring would have a force of between about 11.5 and 13 lbs. The graph of FIG. 7 as well as the spring force referenced with respect to precluding slippage is based on operation of the K-375 machine with a ½ inch snake.

Figure 4:
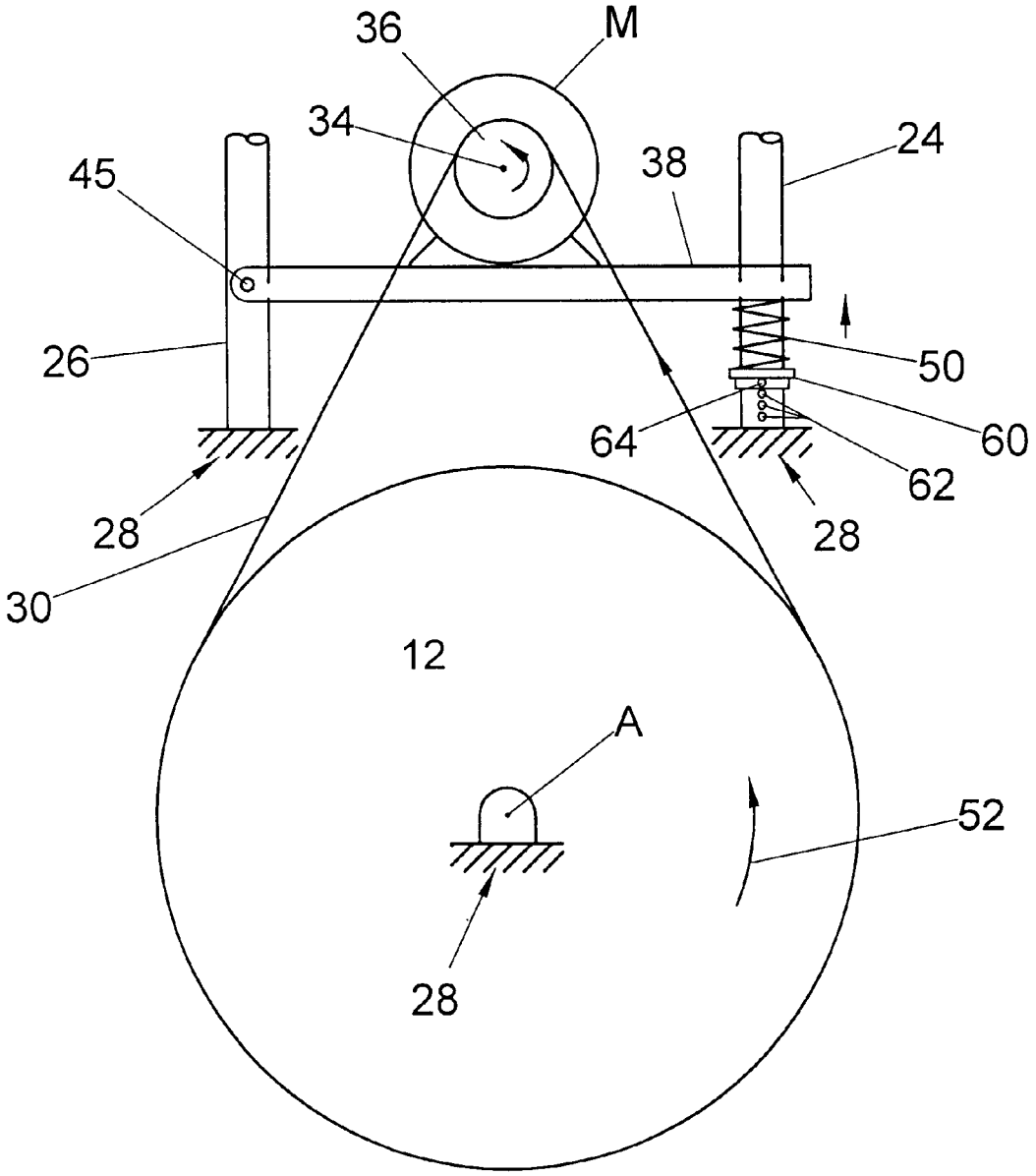
FIG. 4 schematically illustrates a slip clutch arrangement similar to that shown in FIG. 2 and in which the spring force is adjustable.

In connection with each of the foregoing embodiments for obtaining slippage in accordance with the present invention, and as shown in FIG. 4 with respect to the embodiment shown in FIG. 2, the spring force can be adjustable so as to provide adjustment with respect to the predetermined torque at which slippage is desired. Such adjustable spring force advantageously enables the drain cleaning machines to be operable with different diameter snakes and to provide for slippage in response to the application of a predetermined torque to a snake having a given length and diameter. It will be appreciated that a larger diameter snake can take the application of a greater torque without the potential damage resulting from the imposition of the same torque on a smaller diameter snake. Thus, for example, the K-375 machine described hereinabove in connection with FIG. 2 could be adjusted to have slippage occur at a torque of 80–90 in. lbs., whereby the machine would be operable with a ½ inch snake as well as a ⅜ inch snake. Adjustment of the spring force can be achieved in any desired manner and, by way of example only, can be achieved as shown in FIG. 4 by providing frame leg 24 with a collar 60 between the lower end of spring 50 and frame member 28, providing frame leg 24 with a plurality of openings 62 therethrough, providing collar 60 with an opening, not designated numerically, alignable with openings 62, and providing a removable pin 64 by which collar 60 can be positioned at any one of the locations along leg 24 corresponding to openings 62 so as to vary the compression upon spring 50 between collar 60 and support arm 38.

Figure 8:
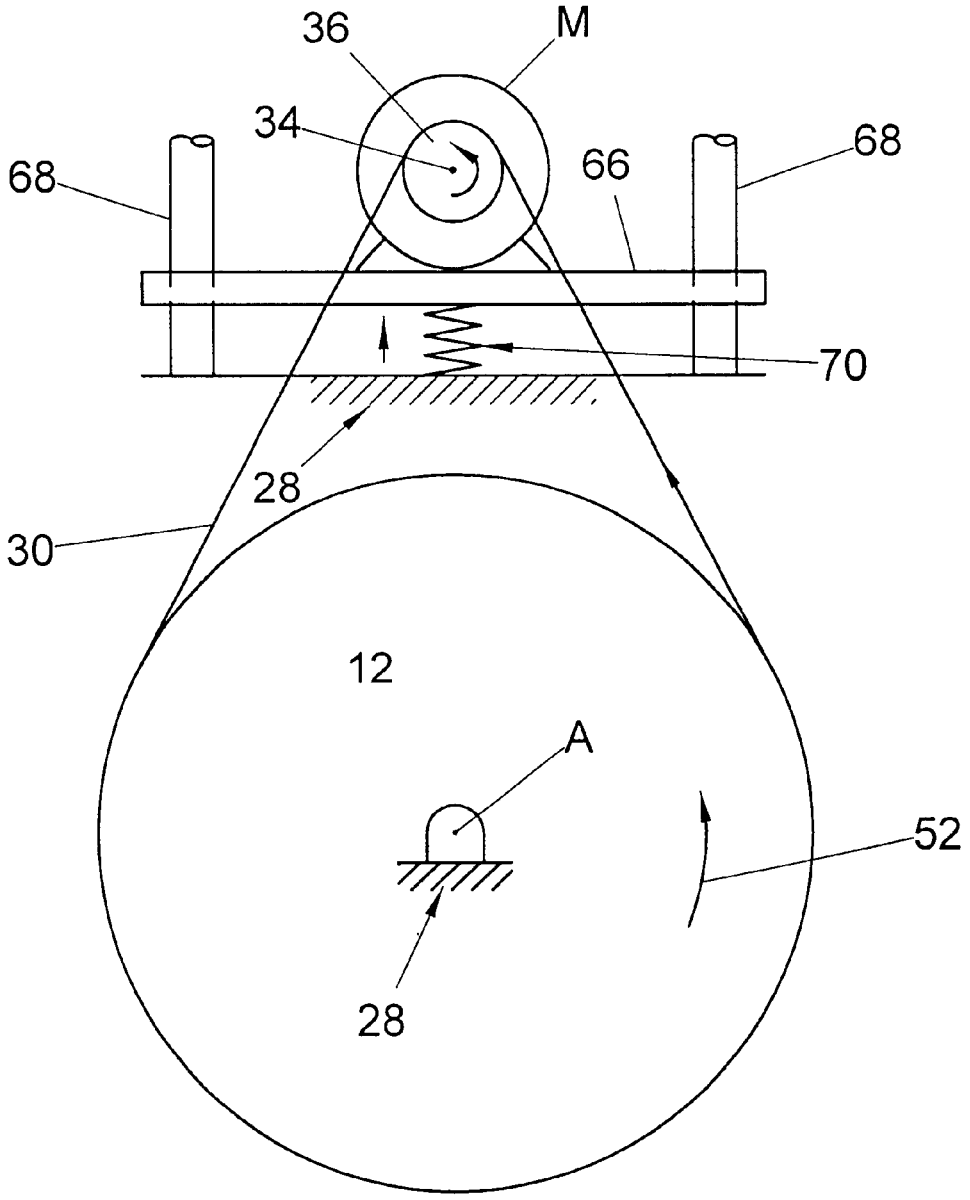

As will be appreciated from FIG. 8, providing slippage between the drive pulley and drive belt in a drum-type drain cleaning machine in accordance with the invention is also applicable to a machine similar to that shown in the aforementioned U.S. Pat. No. 5,309,595 to Salecker, et al. wherein the drive motor support member is biased by a single spring to tension the drive belt. In this respect, as shown in FIG. 8, for example, the motor support table 66 is vertically reciprocable relative to a pair of frame members 68 and is biased by a single compression spring 70 to tension drive belt 30. Spring 70 is centrally between the opposite ends of table 66 so as to apply a spring force which is balanced with respect to the opposite ends of the table.

While particular emphasis has been placed on the preferred embodiments herein illustrated and described, it will be appreciated that other embodiments of the invention can be devised and that modifications can be made in the preferred embodiments without departing from the principles of the invention. Accordingly, it is to be distinctly understood that the foregoing descriptive matter is to be interpreted merely as illustrative of the invention and not as a limitation.

Having thus described the invention, it is so claimed:

1. In drain cleaning apparatus comprising a frame, a cable drum supported on said frame for rotation about a drum axis, said drum having axially spaced front and rear ends and an opening through said front end, a drain cleaning cable coiled in said drum about said axis and having an end for extending through said opening and into a drain to be cleaned, a drive motor supported on said frame, a drive pulley driven by said motor, a drive belt between said drive pulley and drum for rotating said drum and cable, and means including at least one spring biasing said motor to tension said belt, the improvement comprising: said at least one spring having a predetermined force providing for slippage between said belt and drive pulley in response to the imposition of a predetermined torque on said cable during rotation of said drum and cable about said drum axis, and the force of said at least one spring being adjustable.

2. The improvement according to claim 1, wherein said means for providing a predetermined tension includes a member supported on said frame for displacement relative thereto, said motor being mounted on said member for displacement therewith, and said at least one spring biasing said member to displace said motor in a direction to tension said belt.

3. The improvement according to claim 2, wherein said member has opposite ends, one of said ends being pivotally interconnected with said frame, said motor being between said opposite ends, and said at least one spring being a spring at the other of said opposite ends.

4. The improvement according to claim 3, wherein said motor has a motor axis parallel to and spaced from said drum axis, the drum and motor axes lying in a common plane, and said member being between said motor and drum axes and extending laterally of said plane.

5. The improvement according to claim 4, wherein said opposite ends of said member are on opposite sides of said plane.

6. The improvement according to claim 5, wherein said drive pulley is coaxial with said motor axis and said drum has an outer peripheral surface coaxial with said drum axis, said drive belt engaging about said drive pulley and said peripheral surface.

7. The improvement according to claim 2, wherein said member has opposite ends and is supported on said frame for reciprocation transverse to the direction between said opposite ends, and said motor being between said opposite ends.

8. The improvement according to claim 7, wherein said at least one spring is located between said opposite ends of said member to apply a balanced biasing force against said member with respect to said opposite ends.

9. The improvement according to claim 8, wherein said at least one spring includes a pair of springs located between said opposite ends.

10. The improvement according to claim 9, wherein said motor has a motor axis parallel to and spaced from said drum axis, the drum and motor axes lying in a common plane, and said member being between said motor and drum axes and extending laterally of said plane.

11. The improvement according to claim 10, wherein said opposite ends of said member are on opposite sides of said plane.

12. The improvement according to claim 11, wherein said drive pulley is coaxial with said motor axis and said drum has an outer peripheral surface coaxial with said drum axis, said drive belt engaging about said pulley and said peripheral surface.

13. The improvement according to claim 1, wherein said motor has a motor axis and said drive pulley is coaxial with said motor axis, said drum has an outer peripheral surface coaxial with said drum axis, and said drive belt engages about said drive pulley and said peripheral surface.

14. In drain cleaning apparatus comprising a frame, a cable drum supported on said frame for rotation about a drum axis, said drum having axially spaced front and rear ends and an opening through said front end, a drain cleaning cable coiled in said drum about said axis and having an end for extending through said opening and into a drain to be cleaned, a drive motor supported on said frame, a drive pulley driven by said motor, a drive belt between said drive pulley and drum for rotating said drum and cable, and means including at least one spring biasing said motor to tension said belt to preclude slippage between said belt and drive pulley up to a predetermined torque on said cable, the improvement comprising: said at least one spring having a predetermined force providing for slippage between said belt and drive pulley in response to the imposition of a torque greater than said predetermined torque on said cable during rotation of said drum and cable about said drum axis, said means for providing a predetermined tension including a member supported on said frame for displacement relative thereto, said motor being mounted on said member for displacement therewith, said at least one spring biasing said member to displace said motor in a direction to tension said belt, said member having opposite ends, one of said ends being pivotally interconnected with said frame, said motor being between said opposite ends, said at least one spring being a spring at the other of said opposite ends, said motor having a motor axis parallel to and spaced from said drum axis, the drum and motor axes lying in a common plane, said member being between said motor and drum axes and extending laterally of said plane, said opposite ends of said member being on opposite sides of said plane, said drive pulley being coaxial with said motor axis, said drum having an outer peripheral surface coaxial with said drum axis, said drive belt engaging about said drive pulley and said peripheral surface, and the force of said spring being adjustable for varying the tension in said belt.

15. In drain cleaning apparatus comprising a frame, a cable drum supported on said frame for rotation about a drum axis, said drum having axially spaced front and rear ends and an opening through said front end, a drain cleaning cable coiled in said drum about said axis and having an end for extending through said opening and into a drain to be cleaned, a drive motor supported on said frame, a drive pulley driven by said motor, a drive belt between said drive pulley and drum for rotating said drum and cable, and means including at least one spring biasing said motor to tension said belt to preclude slippage between said belt and drive pulley up to a predetermined torque on said cable, the improvement comprising: said at least one spring having a predetermined force providing for slippage between said belt and drive pulley in response to the imposition of a torque greater than said predetermined torque on said cable during rotation of said drum and cable about said drum axis, said means for providing a predetermined tension including a member supported on said frame for displacement relative thereto, said motor being mounted on said member for displacement therewith, said at least one spring biasing said member to displace said motor in a direction to tension said belt, said member having opposite ends and being supported on said frame for reciprocation transverse to the direction between said opposite ends, said motor being between said opposite ends, said at least one spring including a pair of springs located between said opposite ends of said member to apply a balanced biasing force against said member with respect to said opposite ends, said motor having a motor axis parallel to and spaced from said drum axis, the drum and motor axes lying in a common plane, said member being between said motor and drum axes and extending laterally of said plane, said opposite ends of said member being on opposite sides of said plane, said drive pulley being coaxial with said motor axis, said drum having an outer peripheral surface coaxial with said drum axis, said drive belt engaging about said pulley and said peripheral surface, and the force of each spring being adjustable.

16. Drain cleaning apparatus comprising a frame, a rotatable cable storage drum having a drum axis, axially spaced front and rear ends and a radially outer peripheral wall between said ends, said front end having an opening therethrough, means supporting said drum on said frame for rotation about said axis, a drive motor on said frame having a drive pulley, a drive belt engaging about said peripheral wall and pulley and driven by said motor for rotating said drum, a drain cleaning cable coiled in said drum about said axis and between said ends and said outer wall, said cable having an outer end for extending through said opening and into a drain to be cleaned, means including at least one spring for tensioning said belt, said at least one spring having a predetermined force for providing slippage between said belt and said drive pulley in response to the imposition of a predetermined torque on said cable during rotation of said drum and said cable about said axis, and said means for tensioning said belt including means for adjusting the force of said at least one spring.

17. Drain cleaning apparatus according to claim 16, wherein said means for tensioning said belt includes a member supporting said motor on said frame for displacement of said drive pulley toward and away from said belt, said at least one spring biasing said member to displace said pulley toward said belt.

18. Drain cleaning apparatus according to claim 17, wherein said member has opposite ends and is mounted on said frame for pivotal displacement about one of said ends.

19. Drain cleaning apparatus according to claim 18, wherein said motor is mounted on said member between said opposite ends.

20. Drain cleaning apparatus according to claim 19, wherein said at least one spring is spaced from said one end toward the other of said opposite ends of said member.

21. Drain cleaning apparatus according to claim 19, wherein said motor has a motor axis parallel to and spaced from said drum axis, the drum and motor axes lying in a common plane, and said member being between said motor and drum axes and extending laterally of said plane.

22. Drain cleaning apparatus according to claim 21, wherein said at least one spring is at said other end of said member.

23. Drain cleaning apparatus according to claim 17, wherein said member has opposite ends and is supported on said frame for reciprocation transverse to the direction between said opposite ends, said motor being between said opposite ends.

24. Drain cleaning apparatus according to claim 23, wherein said at least one spring is located between said opposite ends of said member to apply a balanced biasing force against said member with respect to said opposite ends.

25. Drain cleaning apparatus according to claim 24, wherein said at least one spring includes a pair of springs located between said opposite ends.

26. Drain cleaning apparatus according to claim 25, wherein said motor has a motor axis parallel to and spaced from said drum axis, the drum and motor axes lying in a common plane, and said member being between said motor and drum axes and extending laterally of said plane.

27. In drain cleaning apparatus comprising a frame, a rotatable cable storage drum having a drum axis, axially spaced front and rear ends and a radially outer peripheral wall between said ends, said front end having an opening therethrough, means supporting said drum on said frame for rotation about said axis, a drive motor on said frame having a drive pulley, a drive belt engaging about said peripheral wall and pulley and driven by said motor for rotating said drum, a drain cleaning cable coiled in said drum about said axis and between said ends and said outer wall, said cable having an outer end for extending through said opening and into a drain to be cleaned, and means including at least one spring for tensioning said belt to preclude slippage between said belt and drive pulley at a torque below a predetermined torque, the improvement comprising: said at least one spring having a predetermined force for providing slippage between said belt and said drive pulley in response to the imposition of a torque above said predetermined torque on said cable during rotation of said drum and said cable about said axis, said means for tensioning said belt including a member supporting said motor on said frame for displacement of said drive pulley toward and away from said belt, said at least one spring biasing said member to displace said pulley toward said belt, said member having opposite ends and being mounted on said frame for pivotal displacement about one of said ends, said motor being mounted on said member between said opposite ends, said at least one spring being spaced from said one end toward the other of said opposite ends of said member, and the force of said at least one spring imposed on said member being adjustable.

28. Drain cleaning apparatus according to claim 27, wherein said at least one spring is at said other end of said member.

29. In drain cleaning apparatus comprising a frame, a rotatable cable storage drum having a drum axis, axially spaced front and rear ends and a radially outer peripheral wall between said ends, said front end having an opening therethrough, means supporting said drum on said frame for rotation about said axis, a drive motor on said frame having a drive pulley, a drive belt engaging about said peripheral wall and pulley and driven by said motor for rotating said drum, a drain cleaning cable coiled in said drum about said axis and between said ends and said outer wall, said cable having an outer end for extending through said opening and into a drain to be cleaned, and means including at least one spring for tensioning said belt to preclude slippage between said belt and drive pulley at a torque below a predetermined torque, the improvement comprising: said at least one spring having a predetermined force for providing slippage between said belt and said drive pulley in response to the imposition of a torque above said predetermined torque on said cable during rotation of said drum and said cable about said axis, said means for tensioning said belt including a member supporting said motor on said frame for displacement of said drive pulley toward and away from said belt, said at least one spring biasing said member to displace said pulley toward said belt, said member having opposite ends and being mounted on said frame for pivotal displacement about one of said ends, said motor being mounted on said member between said opposite ends, said motor having a motor axis parallel to and spaced from said drum axis, the drum and motor axes lying in a common plane, said member being between said motor and drum axes and extending laterally of said plane, said at least one spring being at said other end of said member, and the force of said at least one spring imposed on said member being adjustable.

30. In drain cleaning apparatus comprising a frame, a rotatable cable storage drum having a drum axis, axially spaced front and rear ends and a radially outer peripheral wall between said ends, said front end having an opening therethrough, means supporting said drum on said frame for rotation about said axis, a drive motor on said frame having a drive pulley, a drive belt engaging about said peripheral wall and pulley and driven by said motor for rotating said drum, a drain cleaning cable coiled in said drum about said axis and between said ends and said outer wall, said cable having an outer end for extending through said opening and into a drain to be cleaned, and means including at least one spring for tensioning said belt to preclude slippage between said belt and drive pulley at a torque below a predetermined torque, the improvement comprising: said at least one spring having a predetermined force for providing slippage between said belt and said drive pulley in response to the imposition of a torque above said predetermined torque on said cable during rotation of said drum and said cable about said axis, said means for tensioning said belt including a member supporting said motor on said frame for displacement of said drive pulley toward and away from said belt, said at least one spring biasing said member to displace said pulley toward said belt, said member having opposite ends and being supported on said frame for reciprocation transverse to the direction between said opposite ends, said motor being between said opposite ends, said at least one spring being located between said opposite ends of said member to apply a balanced biasing force against said member with respect to said opposite ends, and the force of said at least one spring imposed on said member being adjustable.

31. In drain cleaning apparatus comprising a frame, a rotatable cable storage drum having a drum axis, axially spaced front and rear ends and a radially outer peripheral wall between said ends, said front end having an opening therethrough, means supporting said drum on said frame for rotation about said axis, a drive motor on said frame having a drive pulley, a drive belt engaging about said peripheral wall and pulley and driven by said motor for rotating said drum, a drain cleaning cable coiled in said drum about said axis and between said ends and said outer wall, said cable having an outer end for extending through said opening and into a drain to be cleaned, and means including at least one spring for tensioning said belt to preclude slippage between said belt and drive pulley at a torque below a predetermined torque, the improvement comprising: said at least one spring having a predetermined force for providing slippage between said belt and said drive pulley in response to the imposition of a torque above said predetermined torque on said cable during rotation of said drum and said cable about said axis, said means for tensioning said belt including a member supporting said motor on said frame for displacement of said drive pulley toward and away from said belt, said at least one spring biasing said member to displace said pulley toward said belt, said member having opposite ends and being supported on said frame for reciprocation transverse to the direction between said opposite ends, said motor being between said opposite ends, said at least one spring including a pair of springs located between said opposite ends of said member to apply a balanced biasing force against said member with respect to said opposite ends, said motor having a motor axis parallel to and spaced from said drum axis, the drum and motor axes lying in a common plane, said member being between said motor and drum axes and extending laterally of said plane, and the force of each spring imposed on said member being adjustable.

32. Drain cleaning apparatus comprising a frame, a cable drum supported on said frame for rotation about a drum axis, said drum having axially spaced front and rear ends and an opening through said front end, a drain cleaning cable coiled in said drum about said axis and having an end for extending through said opening and into a drain to be cleaned, a drive motor mounting member having a first end pivotally interconnected with said frame and a second end spaced from said first end, a drive motor mounted on said mounting member between said first and second ends, a drive pulley driven by said motor, a drive belt between said pulley and drum for rotating said drum, said motor having a motor axis parallel to and spaced from said drum axis, said mounting member being between said motor and drum axes and extending laterally thereof, a spring biasing said member to displace said motor in a direction to tension said belt, said motor being mounted centrally between said first and second ends, and said spring having a force providing for slippage between said belt and drive pulley in response to the imposition of a torque on said cable between about 150 in-lbs. and 160 in-lbs.

33. Drain cleaning apparatus comprising a frame, a cable drum supported on said frame for rotation about a drum axis, said drum having axially spaced front and rear ends and an opening through said front end, a drain cleaning cable coiled in said drum about said axis and having an end for extending through said opening and into a drain to be cleaned, a drive motor mounting member having a first end pivotally interconnected with said frame and a second end spaced from said first end, a drive motor mounted on said mounting member between said first and second ends, a drive pulley driven by said motor, a drive belt between said pulley and drum for rotating said drum, said motor having a motor axis parallel to and spaced from said drum axis, said mounting member being between said motor and drum axes and extending laterally thereof, a spring biasing said member to displace said motor in a direction to tension said belt, said mounting member having a center between said first and second ends, said motor being mounted offset from said center toward said second end, and said spring having a force providing for slippage between said belt and drive pulley in response to the imposition of a torque on said cable between about 50 in-lbs. and 60 in-lbs.

34. Drain cleaning apparatus comprising a frame a cable drum supported on said frame for rotation about a drum axis, said drum having axially spaced front and rear ends and an opening through said front end, a drain cleaning cable coiled in said drum about said axis and having an end for extending through said opening and into a drain to be cleaned, a drive motor mounting member having opposite ends and being supported on said frame for reciprocation transverse to the direction between said opposite ends, a drive motor mounted on said member between said opposite ends, a drive pulley driven by said motor, a drive belt between said drive pulley and drum for rotating said drum, said drive motor having an axis parallel to and spaced from said drum axis, said mounting member being between said motor and drum axes and extending laterally thereof, a pair of springs between said opposite ends of said mounting member for applying a balanced biasing force against said member to displace said motor in a direction to tension said belt, and said springs having a force providing for slippage between said belt and said pulley in response to the imposition of a torque on said cable between about 80 in-lbs. and 90 in-lbs.

* * * * *

UNITED STATES PATENT AND TRADEMARK OFFICE

CERTIFICATE OF CORRECTION

PATENT NO. : 6,381,798 B1
DATED : May 7, 2002
INVENTOR(S) : Rutkowski et al.

It is certified that error appears in the above-identified patent and that said Letters Patent is hereby corrected as shown below:

Column 1,
Line 57, before “the” insert -- and --.

Column 3,
Line 18, “there of” should read -- thereof --.

Column 5,
Line 63, both appearances of “access” should be changed to -- axis --.

Signed and Sealed this

Twenty-ninth Day of October, 2002

*Attest:*

*Attesting Officer*

JAMES E. ROGAN
*Director of the United States Patent and Trademark Office*